US008764174B2

(12) United States Patent
Ma

(10) Patent No.: US 8,764,174 B2
(45) Date of Patent: Jul. 1, 2014

(54) INK CARTRIDGE ON INKJET PRINTER

(71) Applicant: Zhuhai Ninestar Management Co., Ltd., Zhuhai (CN)

(72) Inventor: Haoming Ma, Zhuhai (CN)

(73) Assignee: Zhuhai Ninestar Management Co., Ltd., Guangdong (CN)

( * ) Notice: Subject to any disclaimer, the term of this patent is extended or adjusted under 35 U.S.C. 154(b) by 55 days.

(21) Appl. No.: 13/693,988

(22) Filed: Dec. 4, 2012

(65) Prior Publication Data

US 2013/0093821 A1 Apr. 18, 2013

Related U.S. Application Data

(63) Continuation of application No. PCT/CN2011/072307, filed on Mar. 30, 2011.

(30) Foreign Application Priority Data

Jun. 4, 2010 (CN) ..... 2010 2 0225318 U

(51) Int. Cl.
*B41J 2/175* (2006.01)

(52) U.S. Cl.
CPC ..... *B41J 2/17503* (2013.01); *B41J 2/17553* (2013.01); *B41J 2/1752* (2013.01)
USPC ..... 347/86

(58) Field of Classification Search
USPC ..... 347/85, 86
See application file for complete search history.

(56) References Cited

U.S. PATENT DOCUMENTS

| | | | | |
|---|---|---|---|---|
| 4,641,851 | A * | 2/1987 | Knies | 280/414.1 |
| 5,397,222 | A * | 3/1995 | Moss et al. | 417/477.2 |
| 5,534,899 | A * | 7/1996 | Uchikata et al. | 347/49 |
| 5,742,311 | A * | 4/1998 | Koitabashi et al. | 347/86 |
| 6,554,411 | B1 * | 4/2003 | Hatasa et al. | 347/86 |

(Continued)

FOREIGN PATENT DOCUMENTS

| | | | |
|---|---|---|---|
| CN | 1235302 | A | 11/1999 |
| CN | 101195302 | A | 6/2008 |

(Continued)

OTHER PUBLICATIONS

Abstract of CN201721131U, published on Jan. 26, 2011.*
International Search Report of International Application No. PCT/CN2011/072307, dated Jun. 2, 2011.

*Primary Examiner* — Huan Tran
(74) *Attorney, Agent, or Firm* — J.C. Patents

(57) ABSTRACT

An inkjet printer, which comprises a slide lid slideably connected with the cartridge body, wherein a fixed clamp is formed on both sides of the cartridge body respectively; a movable wall which is engaged and fastened with the fixed clamp at the end is formed on both sides of the slide lid respectively; and a friction force generating component is arranged on one side of the movable wall. Due to the friction forces generated by the friction force generating components, two sidewalls of the movable walls are tightly engaged with the inner wall of the ink cartridge bin of the printer to lock the ink cartridge and fix the ink cartridge into the ink cartridge bin of the printer. The technical problems of poor contact of a chip and abnormal disengagement of an ink container as locking members are loosened when the ink cartridge on the printer can be solved.

10 Claims, 6 Drawing Sheets

(56) References Cited

U.S. PATENT DOCUMENTS

| | | | | |
|---|---|---|---|---|
| 6,932,527 | B2 * | 8/2005 | Pribula et al. | 400/621 |
| 7,806,523 | B2 * | 10/2010 | Seino et al. | 347/86 |
| 2009/0135237 | A1 * | 5/2009 | Nakamura et al. | 347/86 |
| 2011/0169899 | A1 * | 7/2011 | Nozawa et al. | 347/86 |

FOREIGN PATENT DOCUMENTS

| | | | |
|---|---|---|---|
| CN | 101462410 | A | 6/2009 |
| CN | 201721131 | U | 1/2011 |
| JP | 2-88248 | A | 3/1990 |
| JP | 2009-132119 | A | 6/2009 |

* cited by examiner

INK CARTRIDGE ON INKJET PRINTER

CROSS-REFERENCE TO RELATED APPLICATIONS

This application is a continuation of International Application No. PCT/CN2011/072307, filed on Mar. 30, 2011, which claims the priority benefit of Chinese Patent Application No. 201020225318.7, filed on Jun. 4, 2010. The contents of the above identified applications are incorporated herein by reference in their entireties.

FIELD OF THE TECHNOLOGY

The present invention relates to an ink cartridge on an inkjet printer.

BACKGROUND

The traditional inkjet printer usually adopts an inkjet printhead mounted on a carriage which can transversely move back and forth along a printing medium (such as a piece of paper). When the printhead transversely moves along the printing medium, the printhead is driven by a control system to eject or spray ink drops onto the printing medium, so as to form images and characters.

An ink container which can be replaced separately with the printhead is traditionally used by the printer. When the ink of an ink cartridge is out, the ink cartridge is removed and replaced by a new ink container. By adoption of the ink container, a user can independently replace the ink container and does not need to replace the printhead, and then the printhead can be used for printing until the service life of the printhead is ended.

What is favorable to the user of the printer is that: the information is stored into the ink containers, so that the quality of output images can be best and the useability of the printer can be improved. For example, the American patent U.S. Pat. No. 6,264,301 discloses an ink container provided with a storage device which is arranged on the ink container and used for storing the parameters of a printer.

The convenience of the printer is that: after the ink cartridge is installed on the printer by the user, an internal driver of the printer can automatically adjust the status of the printer for the printer to be suitable for printing. The driving conditions include the driving voltage, the pulse width, the frequency and the scheduled discharge. By adoption of the method, the printer can be at the optimum status for printing specified ink and the driving conditions do not need to be manually adjusted.

The information storage device identified by the printer is arranged on the ink container. The printer can only drive corresponding procedures after reading information from the information storage device. For the information storage device of the ink container to be in good contact with the printer, the Chinese patent CN97123110.9 discloses a technique, wherein locking members on an ink container can be engaged with locking members on a printer, so as to guarantee that an information storage device of the printer can be tightly engaged with a contact of the printer; and the locking members on the printer is made from an elastic steel sheet.

FIG. 1 is a schematic diagram illustrating the state when the traditional ink cartridge is installed on a printer, wherein the ink cartridge can be inserted into an ink cartridge installation mechanism 20 of the printer; and an ink cartridge 1 is provided with a given amount of medium printing fluid such as ink.

When the ink cartridge is correctly aligned and installed into the ink cartridge installation mechanism 20, locking members 68 on the printer are engaged with corresponding locking members 64 on the ink cartridge, so as to lock the ink cartridge into the ink cartridge installation mechanism 20. The locking members 68 are made from a steel sheet, and one end of the locking members 68 is fixed on the ink cartridge installation mechanism 20 of the printer. After the ink cartridge is pulled out and inserted in for a plurality of times, an ink level detection component of the printer tends to hit the ink cartridge out of the ink cartridge installation mechanism 20.

The ink level detection of the ink container of the printer adopts the means of hitting, namely using a soft membrane and a pump. When there is ink in the ink container, a detection cavity is sealed by the internal pump; and as there is ink in the detection cavity, the hitting resistance is relatively large when the ink level detection mechanism of the printer hits and a pressure sensor may determine that there is ink in the ink cartridge. When there is no ink in the ink container, the detection cavity is sealed by the internal pump; and as there is no ink in the detection cavity, the volume of internal gas is compressed when the ink level detection mechanism of the printer hits and then the hitting resistance is relatively small, and consequently the pressure sensor may determine that there is no ink in the ink cartridge. As a hitting force of the ink level detection mechanism of the printer is between 1,000N and 1,500N and the hitting direction is consistent with the removing direction of the ink cartridge, the locking members on the printer tends to be loosened after long-term hitting of the printer, and then the problems of poor contact of a chip and abnormal disengagement of the ink container may occur.

SUMMARY

The invention provides an ink cartridge on an inkjet printer to solve the technical problems of poor contact of a chip and abnormal disengagement of an ink container as locking members on the printer are loosened after the printer has hit an ink level detection mechanism of an ink cartridge for a long time when the ink cartridge on the traditional inkjet printer is used.

In order to solve the technical problems, the invention adopts the technical proposal that:

The invention relates to an ink cartridge on an inkjet printer, which comprises a cartridge body and a slide lid slideably connected with the cartridge body, wherein a fixed clamp is formed on both sides of the cartridge body respectively; a movable wall engaged and fastened with the fixed clamp at the end of the fixed clamp is formed on both sides of the slide lid respectively; and a friction force generating component is arranged on one side of the movable wall, close to an ink cartridge bin of the printer.

The friction force generating components are made of sponge or silicone materials with high friction coefficient and adhered to the movable walls via adhesives.

The movable walls are made of elastic polypropylene materials; and one end of each movable wall is connected with the slide lid and the other end of each movable wall moves around the slide lid.

One end of each fixed clamp is fixedly connected with the cartridge body and the other end of each fixed clamp is provided with a filleted clamp.

Movable clamps are formed at positions at which the movable walls are engaged with the filleted clamps of the fixed clamps.

Ribs for guiding the installation of the ink cartridge are formed on the surface of the slide lid, on which at least one movable wall is disposed.

The cartridge body has an ink cavity, a soft membrane, a cartridge body cover, a bottom case, an ink outlet, a lever and a shaft engagement position, wherein the ink cavity is formed between the bottom case and the soft membrane; one end of the lever is fixedly connected with the soft membrane; the central section of the lever is connected with the bottom case via a shaft in the shaft engagement position; and the other end of the lever is engaged with a hitting device of the printer in the case of installation.

The cartridge body also has an information storage device which is a chip for storing the information of the ink cartridge, including the ink level, the color, the model and the production date.

By adoption of the technical proposal, as each friction force generating component is arranged on one side of each movable wall, close to the ink cartridge bin of the printer, two sidewalls of the movable walls are tightly engaged with the inner wall of the ink cartridge bin of the printer to lock the ink cartridge and fix the ink cartridge into the ink cartridge bin of the printer in virtue of the friction forces generated by the friction force generating components. Furthermore, the friction force generating components have certain elasticity, and also have good restorability after long-term use. Therefore, the technical problems of poor contact of the chip and abnormal disengagement of the ink container as the locking members is loosened after the printer has hit the ink level detection mechanism of the ink cartridge for a long time when the ink cartridge on the traditional inkjet printer is used can be solved.

DETAILED DESCRIPTION

For the objectives, technical proposals and advantages of the embodiments of the invention to be clearer, a clear and complete description is given to the technical proposals in the embodiments of the invention with the attached drawings in the embodiments of the invention. Obviously, the embodiments illustrated are only one part of embodiments of the invention and not all the embodiments. All the other embodiments obtained by those skilled in the art based on the embodiments of the invention without providing creative labor shall be all within the scope of protection of the invention.

Figure 1:
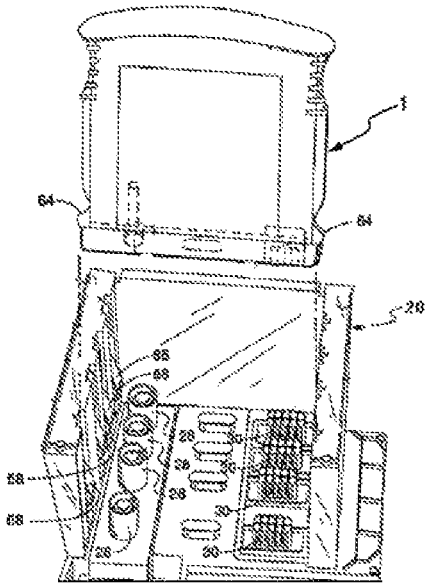
FIG. 1 is a schematic diagram of the traditional ink cartridge installation mechanism and the traditional ink level detection mechanism.
Figure 2:
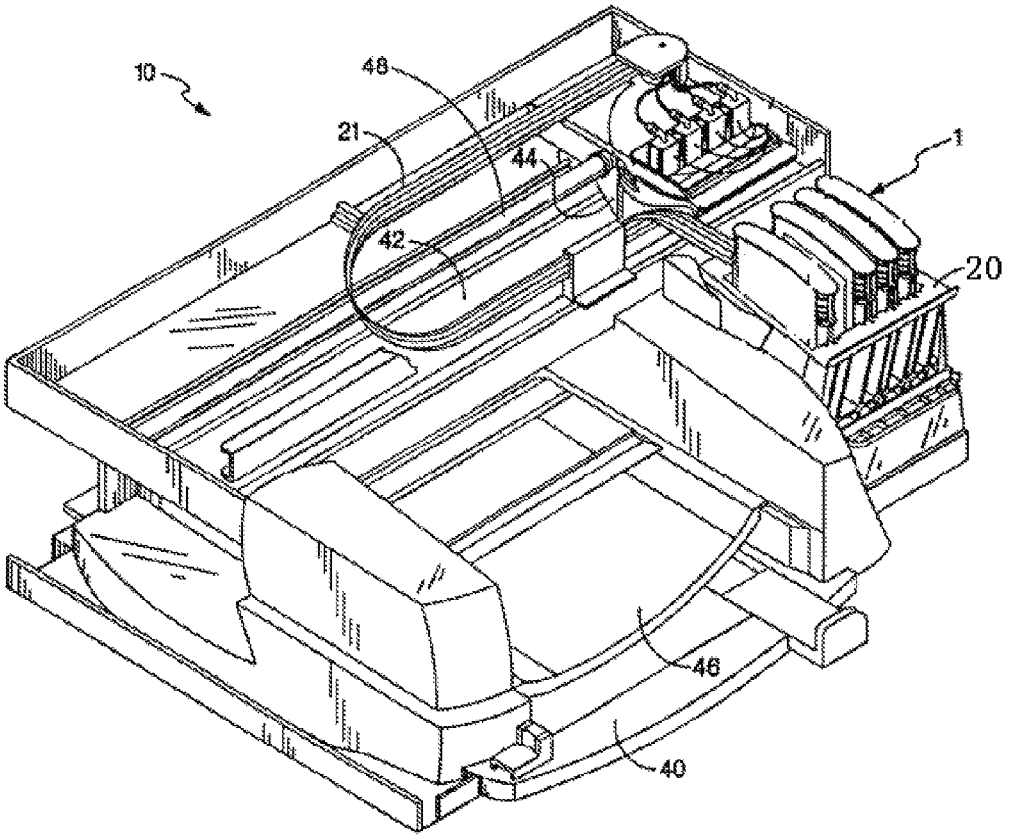
FIG. 2 is a schematic diagram illustrating the state after an ink cartridge of the embodiment of the invention is installed on a printer.
Figure 3:
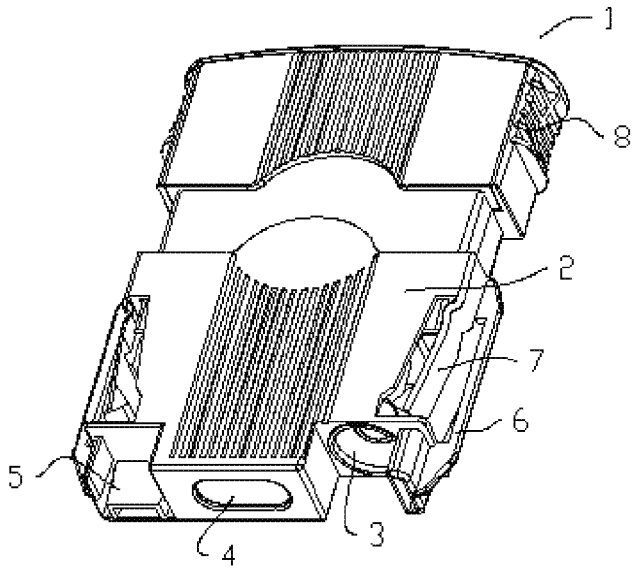
FIG. 3 is a schematic diagram of the ink cartridge of the embodiment of the invention.
Figure 4:
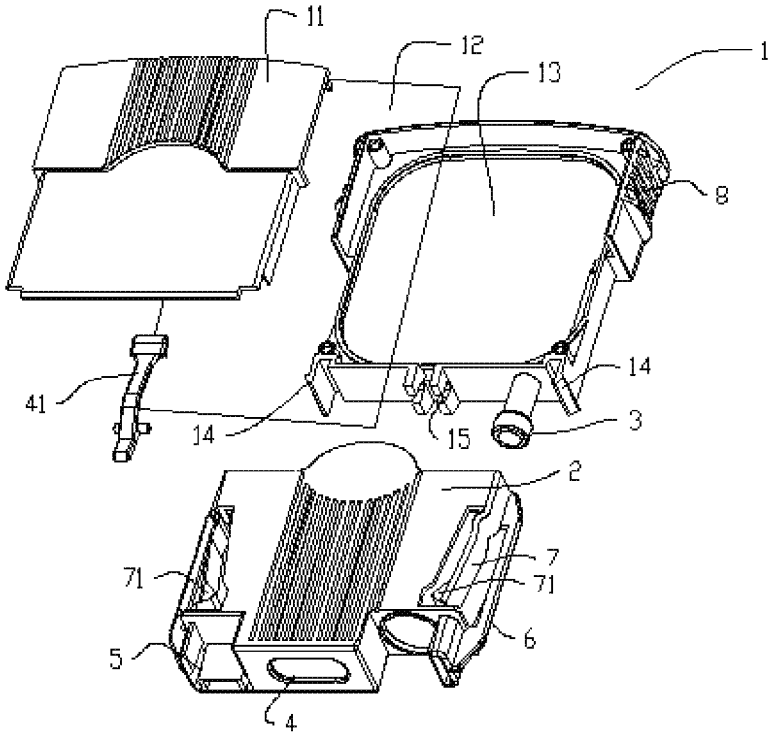
FIG. 4 is an exploded view of the ink cartridge of the embodiment of the invention.
Figure 5:
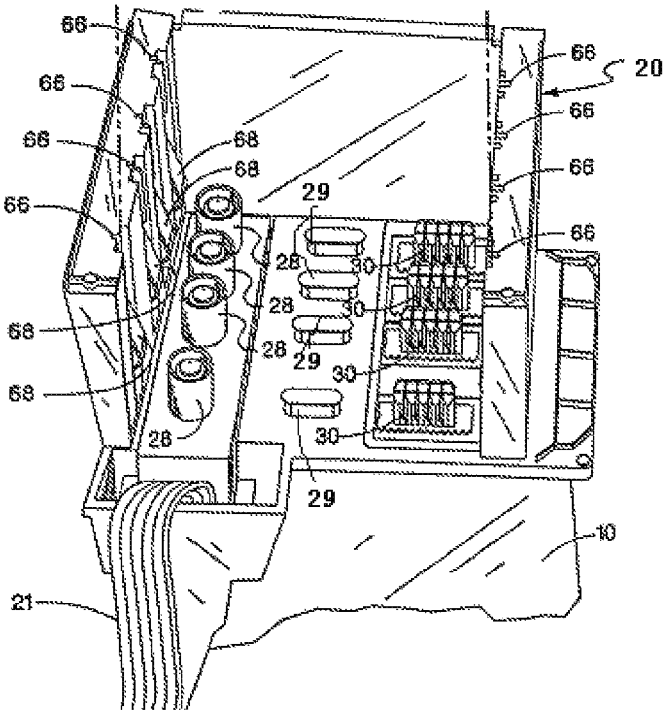
FIG. 5 is a structure diagram of an ink cartridge installation section of the printer in the embodiment of the invention.

FIG. 2 is a schematic diagram illustrating the state after an ink cartridge of the embodiment of the invention is installed on a printer; FIG. 3 is a schematic diagram of the ink cartridge of the embodiment of the invention; FIG. 4 is an exploded view of the ink cartridge of the embodiment of the invention; and FIG. 5 is a structure diagram of an ink cartridge installation section of the printer in the embodiment of the invention. As illustrated in FIGS. 2 to 5, FIG. 2 is a perspective view illustrating the state after the ink cartridge 1 is installed on the printer 10, wherein a cover of the printer 10 is removed, and one or more ink cartridges 1 of the invention are installed in the printer 10. Due to the engagement of a plurality of friction force generating components in the technical proposal of the invention and the ink cartridge installation mechanism 20 of the printer, extremely reliable fluid and electrical connection is provided.

In the embodiment, the printer 10 comprises a tray 40 for fixing a paper supply device. When the printing operation is executed, a piece of paper is conveyed into the printer 10 from the tray 40 via a device for conveying a piece of paper (not illustrated in the figure). In the process of printing paper passing through a print area, a scanning carriage 44 provided with one or more printheads transversely slides along the paper to print an ink line on the paper. When the scanning carriage 44 prints a series of ink lines, the paper passes through the print area 42 step by step, so as to form images on the paper.

After the printing operation is completed, the paper is conveyed to an output tray 46. The positions of the tray 40 and the output tray 46 of the paper supply device can be varied according to a specified paper supply mechanism used.

The scanning carriage 44 moves on a scanning mechanism and passes through the print area 42. The scanning mechanism has a sliding rod 48, a positioning device and a step motor (not illustrated in the figure), wherein the scanning carriage 44 can slide on the sliding rod 48; the positioning device is like an encoding strip (not illustrated in the figure) and used together with a photodetector on the scanning carriage 44 to precisely position the scanning carriage 44; and the step motor is connected to the scanning carriage 44 via a normal driving belt and a belt pulley device and used for driving the scanning carriage to slide along the print area 42.

The scanning mechanism also has an ink ribbon cable (not illustrated in the figure) for conveying electric signals to the scanning carriage 44, so as to selectively excite the printhead. After the printhead is selectively excited, the ink of selected color is ejected onto a printing medium when the scanning carriage 44 passes through the print area 42.

FIG. 3 illustrates an ink container of the embodiment of the invention, namely the ink cartridge 1. The ink cartridge 1 consists of a cartridge body and a slide lid 2, wherein the cartridge body has an ink cavity 13, recesses 8 and an ink level detection mechanism 4. Detailed description of the functions of various components is given below.

The ink cartridge 1 is in the extended state. That is to say, when the slide lid 2 is disposed at a position far away from the ink cavity, the state is the state when the ink cartridge 1 is not installed into the ink cartridge installation mechanism 20 of the printer.

FIG. 4 is an exploded view of the ink cartridge 1 of the embodiment of the invention. Wherein, the ink cartridge 1 can be divided into an ink storage mechanism, an ink level detection mechanism, an ink cartridge locking mechanism, an ink cartridge removing mechanism and an information storage device according to the function.

The ink storage mechanism on the ink cartridge 1 consists of an ink cavity 13, a soft membrane 12, a cartridge body cover 11 and an ink outlet 3.

Wherein, the ink cavity 13 is a receiving cavity for storing ink for a printing device; the main receiving section of the ink cavity 13 includes an injection forming bottom case; the soft membrane 12 is welded on the bottom case by hot welding, so that the soft membrane 12 and the bottom case form a relatively independent cavity which is hermetically engaged with fluid inlets 28 of the printer via the ink outlet 3; and ink is conveyed to the printhead via the ink outlet 3 and the fluid inlets 28 on the printer and ejected onto the printing medium via the printhead.

For the convenience of ink level detection, the ink cavity 13 adopts the means that one end is fixed and the other end is deformable, and the soft membrane 12 at the deformable end tends to be damaged. In order to avoid the phenomenon, the cartridge body cover 11 is arranged to be engaged with the bottom case to protect the soft membrane 12, and then the possibility of damage can be reduced.

The ink level detection mechanism on the ink cartridge consists of a lever 41, the soft membrane 12 and a shaft engagement position 15, wherein one end of the lever 41 is fixedly connected with the soft membrane 12 by hot welding or cementation; a supporting point of the lever 41 is the shaft engagement position 15 which is integrated into a whole with the bottom case, which also means that the lever 14 is connected with the bottom base via a shaft in the shaft engagement position 15; and the other end of the lever 41 is engaged with a hitting device 29 of the printer 10.

When there is ink in the ink cartridge 1, the soft membrane 12 is in the expanded state and drives the lever 41 to move around the shaft in the shaft engagement position 15; the other end of the lever 41 abuts against the hitting device 29 of the printer; and the printer can detect that there is ink in the ink cartridge 1 via the position of the hitting device 29.

When there is no ink in the ink cartridge 1, the soft membrane 12 is absorbed to be shrunken and adhered to a rigid wall of the bottom case and drives the lever 41 to move around the shaft in the shaft engagement position 15; the other end of the lever 41 is deviated from the position at which the other end of the lever 41 abuts against the hitting device 29; and the printer can detect that there is no ink in the ink cartridge 1 via the position variation of the hitting device 29.

The ink cartridge locking mechanism on the ink cartridge 1 consists of the slide lid 2, ribs 6, movable walls 7, fixed clamps 14 and movable clamps 71.

Wherein, the ribs 6, the movable walls 7 and the movable clamps 71 are formed on the slide lid 2; the fixed clamps 14 are formed on the bottom case of the ink cartridge 1; and the slide lid 2 can move relative to the bottom case of the ink cartridge 1. When the ink cartridge is not installed on the printer, the slide lid 2 is away from the bottom case, and meanwhile, the movable walls 7 are in the free state.

The movable walls 7 are made of elastic polypropylene materials; and one end of each movable wall 7 is connected with said slide lid 2 and the other end of each movable wall moves around said slide lid 2. The movable walls 7 are engaged and fastened with said fixed clamp at the end of the fixed clamps 14 respectively.

One end of each fixed clamp 14 is fixedly connected with said cartridge body and the other end of each fixed clamp 14 is provided with a filleted clamp. Further, movable clamps 71 are formed at positions at which said movable walls 7 are engaged with said filleted clamps of said fixed clamps 14.

The ribs 6 can be used for guiding the installation of said ink cartridge 1, which are formed on the surface of said slide lid 2, on which at least one movable wall 7 is disposed.

Friction force generating components are arranged on the outer sidewalls of the movable walls 7, can be integrated into a whole on the movable walls 7, and can also be formed by adhering sponge or silicone materials with high friction coefficient to the movable walls 7.

When the ink cartridge is installed on the printer, firstly, the ribs 6 on the slide lid 2 are engaged with guide grooves 66 on the ink cartridge installation mechanism 20 to guide the ink cartridge to be installed into the ink cartridge installation mechanism 20; and secondly, the ribs 6 are in contact with locking members 68 on the ink cartridge installation mechanism 20 and push away the locking members 68 for the convenience of the installation of the ink cartridge 1. When the slide lid 2 of the ink cartridge 1 abuts against a bottom surface of the inside of the ink cartridge installation mechanism 20, the slide lid 2 does not move again. The bottom case section of the ink cartridge 1 is installed into the ink cartridge installation mechanism 20 of the printer continuously. Herein, the fixed clamps 14 on the bottom case apply pressure to inner walls of the movable walls 7 of the ink cartridge, so that each movable wall 7 moves around the end connected with the slide lid 2. In the case of continuous installation, when the ink outlet 3 is engaged with the fluid inlets 28 and a chip 5 is engaged with electric contacts 30 in place, the fixed clamps 14 on the bottom case of the ink cartridge 1 are clamped with the movable clamps 71 on the movable walls 7. The friction force generating components on the outer sidewalls of the movable walls 7 are engaged with the locking members 68 of the printer to generate large friction forces. After the installing force is canceled, the ink cartridge 1 can lock the printer in virtue of the large friction forces.

The ink cartridge removing mechanism on the ink cartridge 1 consists of two holding sections on the bottom case, wherein the holding sections are the recesses 8 which are disposed on both sides of the ink cartridge 1 and provided with slide-proof parts. When the printer is removed from the ink cartridge installation mechanism 20, fingers are used together with the two recesses 8 on the bottom case of the ink cartridge 1 to pull out the ink cartridge by force. In the pullout process, the fixed clamps 14 are disengaged from the movable clamps 71 first, and the bottom case of the ink cartridge 1 is away from a locking position. Herein, the pressure of the fixed clamps 14 on the movable walls 7 is reduced; the movable walls 7 are restored around the end connected with the slide lid 2; and the friction force generating components are disengaged from the locking members 68 of the printer. Subsequently, the slide lid 2 is pulled out from the ink cartridge installation mechanism 20 by the fixed clamps 14 on the ink cartridge 1.

The information storage device on the ink cartridge 1 consists of the chip 5 for storing various groups of information of the ink cartridge, such as the ink level, the color, the model and the production date. After the ink cartridge is installed on the printer, the chip 5 is communicated with the printer via the electric contacts 30 of the printer, so that the printer and the chip 5 can read and identify related information of each other.

FIG. 5 is a structure diagram of the ink cartridge installation mechanism 20 engaged with the ink cartridge of the embodiment of the invention. The ink cartridge installation mechanism 20 comprises an ink channel 21, the fluid inlets 28, the hitting device 29, the electric contacts 30, the guide grooves 66 and the locking members 68.

Wherein, after the ink cartridge 1 is installed into the ink cartridge installation mechanism 20, the fluid inlets 28 can be hermetically engaged with the ink outlet 3. The ink is driven to flow out of the ink cavity 13 via the ink outlet 3 and flow into the printer via the fluid inlets 28.

The ink channel 21 is a hose formed between the ink cartridge installation mechanism 20 and the printhead. The ink enters into the printer via the fluid inlets 28 and is conveyed to the printhead via the ink channel 21.

The hitting device 29 is the ink level detection device of the printer 10 and determines the ink level in the ink cartridge 1 by the movement of the lever 41 after hitting the lever 41 on the ink cartridge 1.

After the ink cartridge 1 is installed into the ink cartridge installation mechanism 20, the electric contacts 30 are connected with the chip 5 of the ink cartridge, and the printer 10 and the chip 5 exchange electric information via the electric contacts 30.

The guide grooves 66 are grooves formed inside the ink cartridge installation mechanism 20 and have the function of guiding the installation of the ink cartridge 1 in the process of installing the ink cartridge 1 into the ink cartridge installation mechanism 20.

The locking members 68 are spring plates disposed inside the ink cartridge installation mechanism 20, and one end of each spring plate is fixedly connected with the ink cartridge installation mechanism 20. When the ink cartridge 1 is installed into the ink cartridge installation mechanism 20, the locking members 68 are deformed temporarily due to the abutment of the ribs 6 of the ink cartridge 1 and engaged with the friction force generating components of the ink cartridge 1 to lock the ink cartridge after the ink cartridge 1 is installed in place.

Once the ink cartridge installation mechanism 20 and the ink cartridge 1 are correctly aligned and the ink cartridge 1 is installed in place, the locking members 68 are engaged with the friction force generating components on the ink cartridge 1 to lock the ink cartridge. When the ink cartridge 1 is properly connected to the ink cartridge installation mechanism 20 by locking, the fluid inlets 28 may be engaged with the ink outlet 3 on the ink cartridge 1, so that the ink can flow into the printer 10 from the ink cartridge 1 via the ink channel 21 and finally flow into the printhead and be used for printing on the printing medium.

After the ink cartridge 1 is correctly installed into the ink cartridge installation mechanism 20, the ink cartridge 1 and the ink cartridge installation mechanism 20 form electrical interconnection and fluid (ink) interconnection, and the chip 5 on the ink cartridge 1 is engaged with the corresponding electric contacts 30 on the ink cartridge installation mechanism 20, so as to convey information between the printer 10 and the ink cartridge 1.

Figure 6:
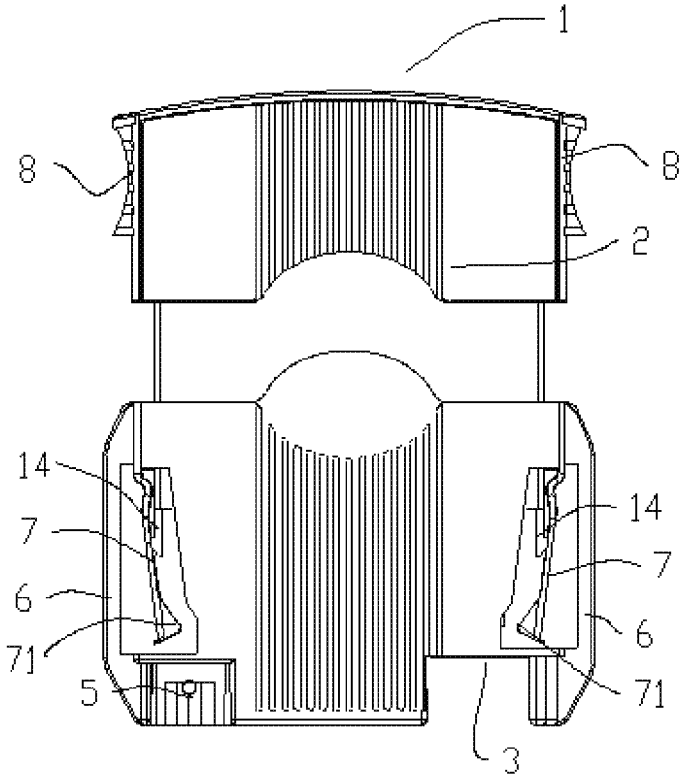
FIG. 6 is a schematic diagram illustrating the state when the ink cartridge of the embodiment of the invention is not installed on the printer.

FIG. 6 is a schematic diagram illustrating the state when the ink cartridge of the embodiment of the invention is not installed into the ink cartridge installation mechanism 20. Wherein, due to the interaction between the insides of the movable walls 7 and the fixed clamps 14 on the bottom case, the slide lid 2 is at a position far away from the bottom case of the ink cartridge 1, and both the ink outlet 3 and the lever 41 are protected by the slide lid 2.

Figure 7:
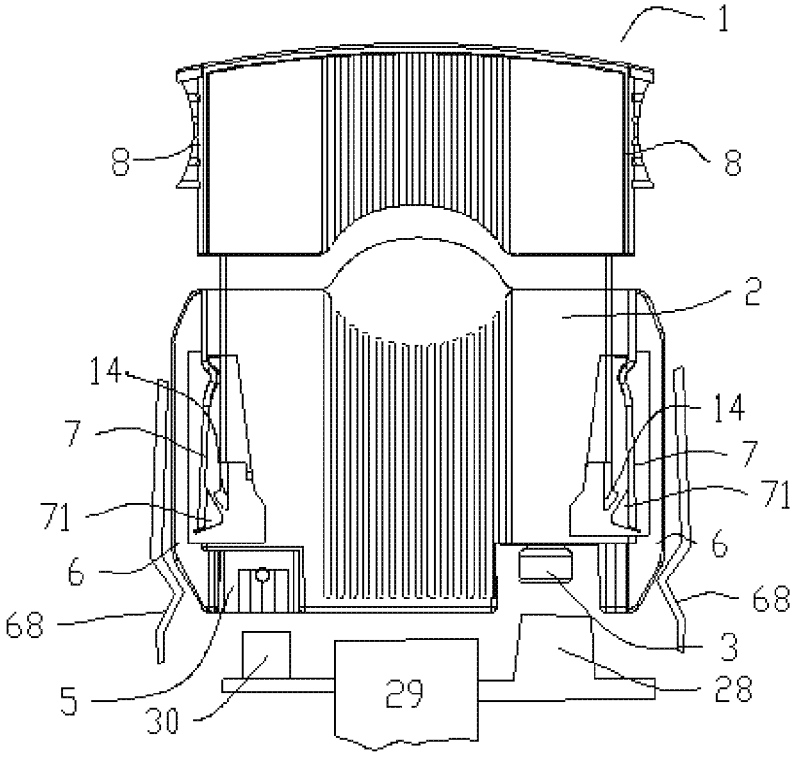
FIG. 7 is a state diagram illustrating the process of installing the ink cartridge of the embodiment of the invention on the printer.

FIG. 7 is a state diagram illustrating the process of installing the ink cartridge of the embodiment of the invention into the ink cartridge installation mechanism 20. When the ink cartridge 1 is installed into the ink cartridge installation mechanism 20, firstly, the ribs 6 on the slide lid 2 are engaged with the guide grooves 66 on the ink cartridge installation mechanism 20 to guide the installation of the ink cartridge; and secondly, the ribs 6 are in contact with the locking members 68 on the ink cartridge installation mechanism 20 and push away the locking members 68 for the convenience of the installation of the ink cartridge 1. When the slide lid 2 of the ink cartridge 1 abuts against the bottom surface of the inside of the ink cartridge installation mechanism 20, the slide lid 2 does not move again. The bottom case section of the ink cartridge 1 is installed into the ink cartridge installation mechanism 20 continuously. Herein, the fixed clamps 14 on the bottom case apply pressure to the inner walls of the movable walls 7 of the ink cartridge, so that the movable walls 7 move around the end connected with the slide lid 2. In the case of continuous installation, when the ink outlet 3 is engaged with the fluid inlets 28 and the chip 5 is engaged with the electric contacts 30 in place, the fixed clamps 14 on the bottom case of the ink cartridge 1 are clamped with the movable clamps 71 on the movable walls 7. The friction force generating components on the outer sidewalls of the movable walls 7 are engaged with the locking members 68 of the printer to generate the large friction forces. After the installing force is canceled, the ink cartridge 1 can lock the printer in virtue of the large friction forces.

Figure 8:
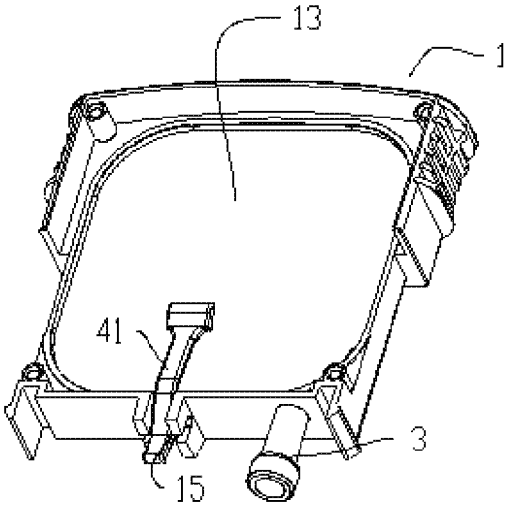
FIG. 8 is a structure diagram of an ink level detection mechanism in the ink cartridge of the embodiment of the invention.

FIG. 8 is a structure diagram of the bottom case and the lever of the ink cartridge 1 of the invention. Wherein, the bottom case has the ink cavity 13, the ink outlet 3 and the shaft engagement position 15; the lever 41 is connected with the bottom case via the shaft engagement position 15; one end of the lever 41 is fixedly connected with the soft membrane 12 by cementation or hot welding and moves around the shaft in the shaft engagement position 15 along with the deformation of the soft membrane 12; the ink outlet 3 is directly communicated with the ink cavity 13; a seal ring (not illustrated in the figure) is arranged inside the ink outlet 3 to seal the whole ink cavity.

After the ink cartridge is installed into the ink cartridge installation mechanism 20, the hitting device 29 of the printer is engaged with the lever of the ink cartridge 1 to detect the ink level of the ink cartridge 1.

It shall be finally noted that the above embodiments are only used for illustrating the technical proposal of the invention and not intended to limit the invention. Although detailed description is given to the invention with the preferred embodiments, it shall be understood by those skilled in the art that the technical proposals illustrated in various embodiments can be also modified or partial technical characteristics can be subjected to equivalent replacement; and the modifications or replacements shall not allow the essence of corresponding technical proposals to be departed from the spirit and scope of the technical proposals of various embodiments of the invention.

What is claimed is:

1. An ink cartridge on an inkjet printer, comprising a cartridge body and a slide lid slideably connected with said cartridge body, wherein a fixed clamp formed on both sides of said cartridge body respectively; a movable wall engaged and fastened with said fixed clamp formed on both sides of said slide lid respectively; and a friction force generating component arranged on one side of said movable wall, close to an ink cartridge bin of said printer.

2. The ink cartridge on an inkjet printer according to claim 1, wherein said friction force generating component is made of sponge or silicone materials with high friction coefficient and adhered to said movable walls via adhesives.

3. The ink cartridge on an inkjet printer according to claim 1, wherein said movable walls are made of elastic polypropylene materials; and one end of each movable wall is connected with said slide lid and the other end of each movable wall moves around said slide lid.

4. The ink cartridge on an inkjet printer according to claim 1, wherein one end of each fixed clamp is fixedly connected with said cartridge body and the other end of each fixed clamp is provided with a filleted clamp.

5. The ink cartridge on an inkjet printer according to claim 4, wherein movable clamps are formed at positions at which said movable walls are engaged with said filleted clamps of said fixed clamps.

6. The ink cartridge on an inkjet printer according to claim 4, wherein ribs for guiding the installation of said ink cartridge are formed on the surface of said slide lid, on which at least one movable wall is disposed.

7. The ink cartridge on an inkjet printer according to claim 4, wherein said cartridge body has an ink cavity, a soft membrane, a cartridge body cover, a bottom case, an ink outlet, a lever and a shaft engagement position; said ink cavity is formed between said bottom case and said soft membrane; one end of said lever is fixedly connected with said soft membrane; the central section of said lever is connected with said bottom case via a shaft in said shaft engagement position; and the other end of said lever is engaged with a hitting device of said printer in the case of installation.

8. The ink cartridge on an inkjet printer according to claim 4, wherein said cartridge body also has an information storage device which is a chip for storing the information of said ink cartridge, including the ink level, the color, the model and the production date.

9. The ink cartridge on an inkjet printer according to claim 1, wherein said friction force generating component is engaged with a locking member of the printer to generate large friction force when the ink cartridge is installed on the printer.

10. The ink cartridge on an inkjet printer according to claim 9, wherein said friction force generating component is disengaged from the locking member of the printer when the ink cartridge is removed from the printer.

* * * * *